United States Patent [19]

Kawaguchi

[11] Patent Number: 5,014,029

[45] Date of Patent: May 7, 1991

[54] DEFLECTION YOKE FOR CATHODE RAY TUBE

[75] Inventor: Takeo Kawaguchi, Nagaokakyo, Japan

[73] Assignee: Mitsubishi Denki Kabushiki Kaisha, Kyoto, Japan

[21] Appl. No.: 376,382

[22] Filed: Jul. 5, 1989

[30] Foreign Application Priority Data

Jul. 6, 1988 [JP] Japan ..... 63-89793[U]

[51] Int. Cl.[5] ..... H01F 7/00

[52] U.S. Cl. ..... 335/210; 335/212

[58] Field of Search ..... 335/210, 212; 313/421, 313/430, 431

[56] References Cited

U.S. PATENT DOCUMENTS

| | | | |
|---|---|---|---|
| 3,191,105 | 6/1965 | Robinson | 335/212 |
| 3,550,038 | 12/1970 | Shizu | 335/212 X |
| 3,689,860 | 9/1972 | Bauzhis et al. | 335/210 |
| 3,906,418 | 9/1975 | Doshi et al. | 335/210 |
| 4,143,345 | 3/1979 | Barkow | 335/213 |
| 4,246,560 | 1/1981 | Shimizu et al. | 335/212 |
| 4,257,023 | 3/1981 | Kamijo | 335/211 |
| 4,470,029 | 9/1984 | Chase | 335/210 |
| 4,556,857 | 12/1985 | Logan | 335/210 |

*Primary Examiner*—George Harris

[57] ABSTRACT

A deflection yoke assembly for use on a cathode ray tube including an evacuated envelope, a coil separator mounted exteriorly on the evacuated envelope at a location corresponding to the boundary betweeen the funnel section and the neck section and having a generally conical portion, a radially outwardly flanged front end portion at one end of the conical portion and a radially outwardly flanged rear end portion at the opposite end of the conical portion, a pair of horizontal deflection coils and a pair of vertical deflection coils both wound on the coil separator. The deflection yoke assembly comprises a vertical deflection distortion correcting unit including two electromagnetic coil devices mounted on at least said radially outwardly flanged front end portion of the coil separator in alignment with a vertical axis of the evacuated envelope while spaced 180° circumferentially about the longitudinal axis of the envelope. The electromagnetic devices are adapted to generate magnetic fluxes in a direction substantially perpendicular to the vertical axis when electrically energized in synchronism with the cycle of vertical deflection, exercised by the vertical deflection coils, for minimizing raster distortions.

29 Claims, 6 Drawing Sheets

DEFLECTION YOKE FOR CATHODE RAY TUBE

BACKGROUND OF THE INVENTION

1. Field of the Invention

The present invention generally relates to a color cathode ray tube utilizing an in-line electron gun assembly and, more particularly, to a deflection yoke assembly used in the in-line color cathode ray tube.

2. Description of the Prior Art

The prior art in-line color cathode ray tube, that is, the cathode ray tube of a type wherein three electron guns are arranged in a line generally parallel to the direction of sweep of electron beams across the phosphor deposited screen, is schematically illustrated in longitudinal sectional representation in FIG. 6. As shown in FIG. 6, the cathode ray tube includes a highly evacuated envelope generally identified by 1, which envelope 1 comprises a funnel section 1B generally flared in one direction and having reduced and enlarged diameter ends at its opposite ends. A faceplate 1A is sealed to the enlarged diameter end of the funnel section 1B and a phosphor deposited screen **1*b* is formed on an inner surface thereof in the form of a pattern of triads of phosphor stripes. A generally cylindrical neck section 1C continues from the reduced diameter end of the funnel section 1B in a direction away from the faceplate 1A and an in-line electron gun assembly 2 is accommodated therein which includes three electron guns for the emission of electron beams 2B, 2G and 2R of different elemental colors, for example, blue, green and red. The envelope 1 also comprises a finely Perforated shadow mask 4 having a multiplicity of minute apertures for the selective passage of the electron beams 2B, 2G and 2R emitted from the respective electron guns of the electron gun assembly 2**.

A deflection yoke assembly generally identified by 3 is mounted exteriorly on the highly evacuated envelope 1 at a location adjacent the boundary between the funnel section 1B and the neck section 1C. This deflection yoke assembly 3 comprises a pair of generally saddle-type horizontal deflection coils and a pair of generally toroidal vertical deflection coils both housed within a coil separator 3A of a shape having a radially outwardly flared front portion adjacent the reduced diameter end of the funnel section 1B, a generally conical portion and a radially outwardly flared rear portion adjacent the neck section 1C.

The color cathode ray tube of the above described construction operates in the following manner.

The electron beams 2B, 2G and 2R of different colors emitted from the electron gun assembly 2 sweep across the phosphor deposited screen **1*b* from left to right and from top to bottom by the action of the horizontal deflection magnetic field and the vertical deflection magnetic field developed respectively by the horizontal deflection coils and the vertical deflection coils in the deflection yoke assembly 3. After having been deflected about the center of deflection and prior to the electron beams 2B, 2G and 2R impinging upon the phosphor deposited screen 1*b*, the electron beams 2B, 2G and 2R of different colors pass through the minute apertures in the perforated shadow mask 4 and then impinge upon corresponding phosphor deposits on the phosphor deposited screen 1*b* to excite such corresponding phosphor deposits to illuminate to thereby form a color image. The impingement of the electron beams 2B, 2G and 2R upon the phosphor deposited screen 1*b*** to excite the corresponding phosphor deposits is well known as a landing.

In most conventional color cathode ray tubes, it is quite usual that the radius of curvature of the phosphor deposited screen **1*b* is greater than the distance between the center of deflection of the electron beams and the center of the phosphor deposited screen 1*b* in alignment with the longitudinal axis of the evacuated envelope 1 and, therefore, the distance from the center of deflection to the. phosphor deposited screen 1*b* progressively increases with increase of the distance from the center of the phosphor deposited screen 1*b* to the perimeter of the phosphor deposited screen 1*b*. In other words, the center of curvature of the phosphor deposited screen 1*b* is not at the center of deflection of the electron beams. In such type of color cathode ray tube, where the deflecting magnetic fields developed by the deflection yoke 3 in horizontal and vertical directions are uniform and the color electron beams 2B, 2G and 2R are deflected by these uniform deflecting magnetic fields, the color rasters produced on the phosphor deposited screen 1*b* by the intermediate electron beam 2G and the side electron beams 2B and 2R on respective sides of the intermediate electron beam 2G do not exactly match with each other, particularly at a peripheral portion of the phosphor deposited screen 1*b* as shown in FIG. 7, thus creating a condition known as a dynamic misconvergence. It is to be noted that, in FIGS. 6 and 7, the direction parallel to the longitudinal axis of the evacuated envelope 1 is expressed by Z, and horizontal and vertical directions perpendicular to the direction Z are expressed respectively by X and y, all of these directions X, y and Z being as viewed on the phosphor deposited screen 1*b***.

In the color cathode ray tube tending to exhibit the dynamic misconvergence, if the distribution of the deflection magnetic fields developed by the deflection yoke assembly 3 is so designed and so chosen that the horizontal deflecting magnetic field can produce such a pincushion distortion as shown in FIG. 8 while the vertical deflecting magnetic field can produce such a barrel distortion as shown in FIG. 9, the side electron beams 2B and 2R can be converged at respective locations on the phosphor deposited screen **1*b* as shown in FIG. 10. At this time, although a distortion caused by the coma aberration renders the color raster produced by the center electron beam 2G to be somewhat undersized as compared with the color raster produced by each of the side electron beams 2B and 2R, the difference in size of the color rasters can be compensated for if the magnetic field leaking from a neck region of the deflection yoke assembly 3 is controlled by the use of a magnetic field controlling element directed to each electron beam so as to render the center electron beam 2G and the side electron beams 2B and 2R to substantially coincide with each other on the phosphor deposited screen 1*b***.

On the other hand, the raster distortion depends on a distribution of deflection magnetic fields. Specifically, top and bottom pincushion distortions PQ1 and left and right pincushion distortions PQ2 shown in FIG. 7 as appearing on the phosphor deposited screen **1*b*** are mainly attributable to the distribution of the horizontal deflection magnetic field and the distribution of the vertical deflection magnetic field, respectively, and can be minimized as the deflection magnetic fields are so developed as to produce the pin-cushion distortions.

Accordingly, if in order to compensate for the misconvergence the horizontal deflection magnetic field is strongly distributed in a pattern similar to the pincushion distortion as shown in FIG. 8 and the vertical deflection magnetic field is strongly distributed in a pattern similar to the barrel distortion as shown in FIG. 9, the top and bottom pincushion distortions PQ1 appearing on the phosphor deposited screen 1*b* can be substantially eliminated, but the left and right pincushion distortions PQ2 will be enhanced.

In view of the foregoing, it is a general practice to employ the system wherein, as shown in FIG. 11, a portion of the deflection yoke assembly 3 facing towards the phosphor deposited screen 1*b* is so tailored as to develop a pincushion magnetic field while the remaining portion of the deflection yoke assembly 3 is so tailored as to develop a substantially intensified barrel-shaped magnetic field, thereby rendering the total amount of the vertical deflection magnetic field, which would act on the electron beams 2B, 2G and 2R, to represent a generally barrel-shaped field. With this system, no correction of the dynamic convergence is required and, at the same time, no dynamic correction of the raster distortions is also required.

A technique to render the correction of the dynamic convergence and the raster distortions to be unnecessary is disclosed in any one of the U.S. Pat. Nos. 4,143,345, 4,246,560 and 4,257,023, issued Mar. 6, 1979, Jan. 20, 1981, and Mar. 17, 1981, respectively According to these United States Patents, the use has been made of magnetic pieces arranged at the center portion of the yoke length or in the vicinity of the vertical deflection coils.

However, if the curvature of the phosphor deposited screen 1*b* of the color cathode ray tube is small or the phosphor deposited screen 1*b* of the color cathode ray tube is of a shape composed of a plurality of curvatures, both of the complete convergence and the elimination of the raster distortions by relying only on the distribution of the magnetic fields developed by the deflection coils or on a combination of the distribution of the magnetic fields developed by the deflection coils with the magnetic pieces cannot be accomplished without difficulty.

FIG. 12 illustrates the conventional deflection yoke assembly, as viewed from rear, which has been contemplated to accomplish both of the convergence and the correction of the raster distortions. In FIG. 12, reference numeral 5 represents a pair of permanent magnets mounted on the radially outwardly flared front portion 3*a* of the coil separator 3A of the deflection yoke assembly 3 in alignment with a vertical axis y perpendicular to the longitudinal axis of the evacuated envelope, which magnets 5 are operable to correct top and bottom raster distortions and also to correct both of the convergence and the raster distortions by means of the distribution of the magnetic fields developed by the deflection coils.

In the conventional deflection yoke assembly of the above described construction, where the color cathode ray tube is so designed and so structured that the curvature of the phosphor deposited screen in the horizontal direction and that in the vertical direction can be expressed by secondary and fourth-order functions, respectively, the use of the permanent magnets capable of emanating a high magnetic force is required, and, even though raster distortions at top and bottom of the phosphor deposited screen 1*b* as shown in FIG. 13 could be successfully eliminated by the employment of the permanent magnets of high magnetic force, gull distortions PQ3 appearing at a portion of the phosphor deposited screen 1*b* generally intermediate between the center and the top or the bottom as shown in FIG. 13 cannot be successfully eliminated. Also, since the permanent magnets of high magnetic force are employed, any variation in gaussing force of the permanent magnets tends to adversely affect the raster distortions and the landing characteristic of the electron beams.

SUMMARY OF THE INVENTION

The present invention has been devised with a view to substantially alleviating the above discussed problems inherent in the prior art deflection yoke assemblies in color cathode ray tubes and has for its essential object to provide an improved deflection yoke assembly effective to ensure an optimum reproduction of color images with neither mislanding nor raster distortions being substantially accompanied.

The deflection yoke assembly according to the present invention is featured in that two electromagnetic coil devices are mounted on at least that radially outwardly extending front flange of the coil separator in alignment with the vertical axis perpendicular to the longitudinal axis of the evacuated envelope while spaced 180° circumferentially about the longitudinal axis of the envelope. These electromagnetic coil devices employed in accordance with the present invention are adapted to be energized in synchronism with the cycle of vertical deflection exercised by the vertical deflection coils for generating magnetic fluxes in a direction substantially perpendicular to the vertical axis.

Specifically, according to the present invention, when the electromagnetic coil devices are supplied with a vertical deflecting current, the electromagnetic coil devices generate, in synchronism with the cycle of vertical deflection, the magnetic fluxes in a direction substantially perpendicular to the vertical axis. Since the magnetic fluxes so generated can be intensified at a portion intermediate of the vertical axis, the raster distortion appearing at an intermediate portion of the phosphor deposited screen can be substantially eliminated.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, wherein:

FIG. 1(*c*) is a cross-sectional view taken along the line C—C in FIG. 1(*a*);

DETAILED DESCRIPTION OF THE EMBODIMENTS

Figure 1B:
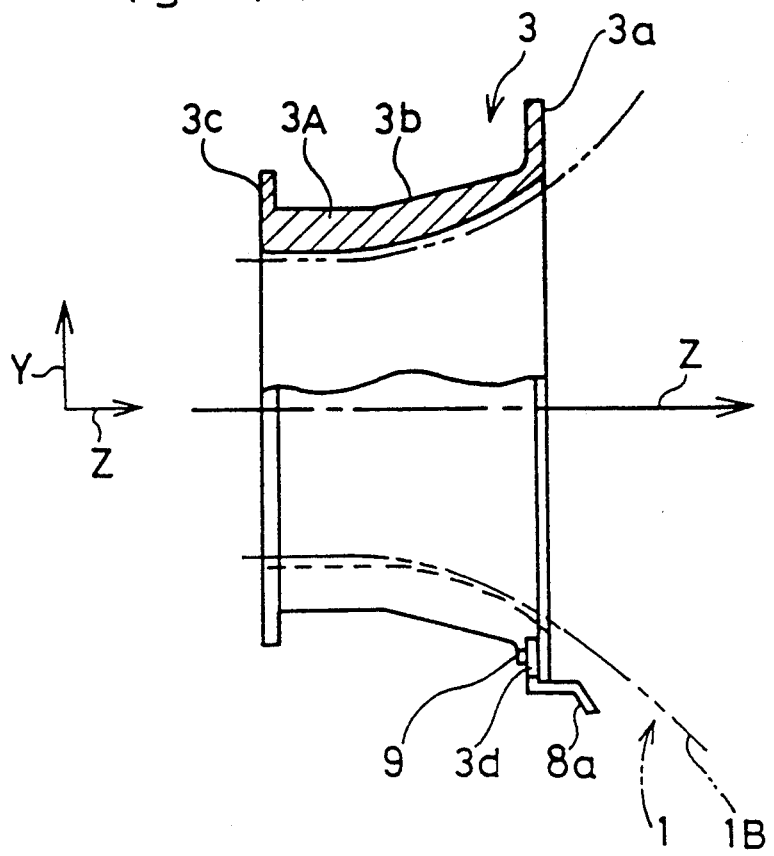
FIG. 1(a) is a schematic rear end view of a deflection yoke assembly according to a preferred embodiment of the present invention.
FIG 1(*b*) is a side sectional view, on an enlarged scale, showing a portion of the deflection yoke assembly of FIG. 1(*a*)
Figure 1C:
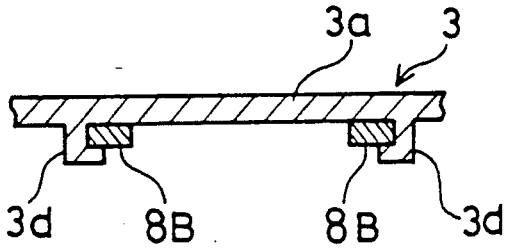
Figure 1A:
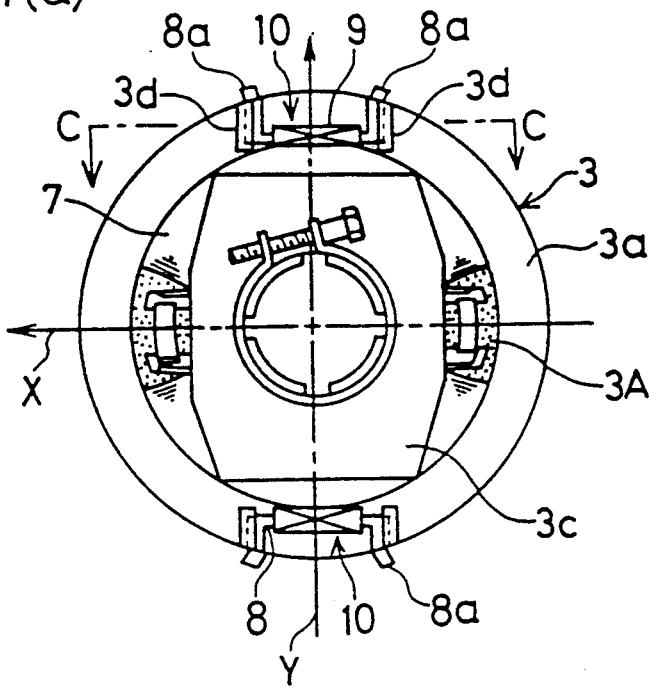

Referring to FIGS. 1(*a*) to 1(*c*) and 2, a deflection yoke assembly is generally identified by 3 and comprises a coil separator 3A of one-piece construction including a radially outwardly extending front flange portion 3*a*, a generally conical intermediate portion 3*b* and a radially outwardly extending rear flange portion 3*c*.

The illustrated deflection yoke assembly 3 also comprises a pair of generally saddle-shaped horizontal deflection coils (not shown) enclosed in the coil separator 3A and operable for deflecting the electron beams in a horizontal direction so as to sweep across the phosphor deposited screen of the color cathode ray tube, a pair of generally toroidal vertical deflection coils 7 enclosed in the coil separator 3A for deflecting the, electron beams in a vertical direction from top to bottom on the phosphor deposited screen, and upper and lower electromagnetic assemblies 10 mounted on the coil separator 3A in alignment with the vertical axis, that is, the y-axis, and spaced 180° circumferentially from each other about the longitudinal axis Z of the envelope of the color cathode ray tube.

Figure 2:
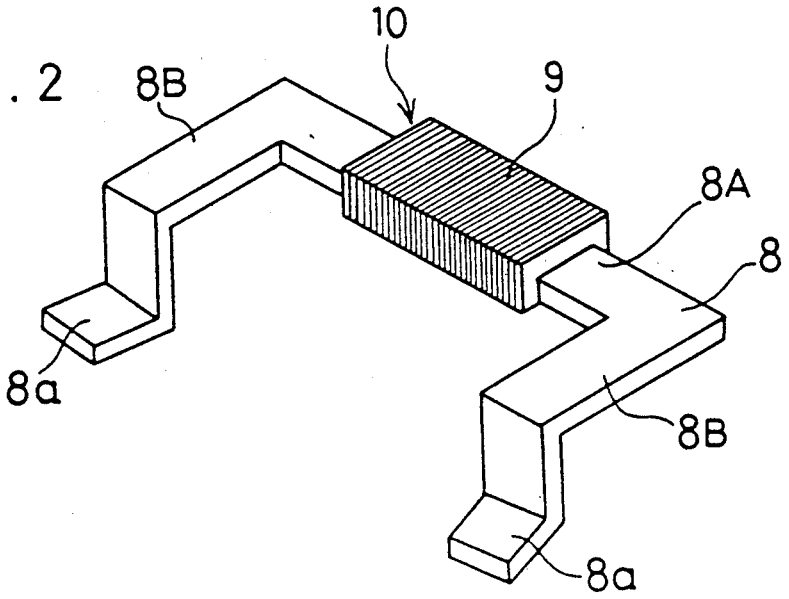
FIG. 2 is a perspective view, on an enlarged scale, showing one of two electromagnets used in the deflection yoke assembly of the present invention.

As clearly shown in FIG. 2, each of the electromagnetic assemblies 10 comprises a magnetic core in the form of a generally U-shaped magnetic core member 8 made of high magnetic permeable material such as, for example, a silicon containing steel plate or Permalloy, which member 8 has a pair of arms 8B and an interconnecting core 8A extending perpendicular to and connecting the arms 8B together. Each electromagnetic assembly 10 also comprises a first distortion correcting coil 9 wound around and mounted on the interconnecting core 8A of the respective U-shaped magnetic core member 8 and is mounted on the radially outwardly extending front flange portion 3*a* of the coil separator 3A in a manner as best shown in FIG. 1(*c*). More specifically, the radially outwardly extending front flange portion 3*a* of the coil separator 3A has spaced apart gutters 3*d* formed thereon and extending parallel to the y-axis for receipt of the respective arms 8B of the magnetic core member 8. The associated magnetic core member 8 is mounted on the radially outwardly extending front flange portion 3*a* of the coil separator 3A with the arms 8B snugly engaged in the respective gutters 3*d* while, as shown in FIG. 1(*b*), free ends 8*a* continued from the arms 8B protrude outwardly from the gutters 3*d* towards the funnel section 1B of the evacuated envelope. In this mounted condition, the interconnecting core 8A of each magnetic core member 8 lies parallel to the X axis, that is, the horizontal direction, and perpendicular to the y-axis, that is, the vertical direction.

As clearly shown in FIG. 1(*a*), the two magnetic core members 8 each being of the construction described above are mounted on the coil separator 3A at respective locations aligned with the y-axis and spaced 180° circumferentially from each other about the Z-axis, that is, the longitudinal axis of the evacuated envelope of the color cathode ray tube.

Figure 3:
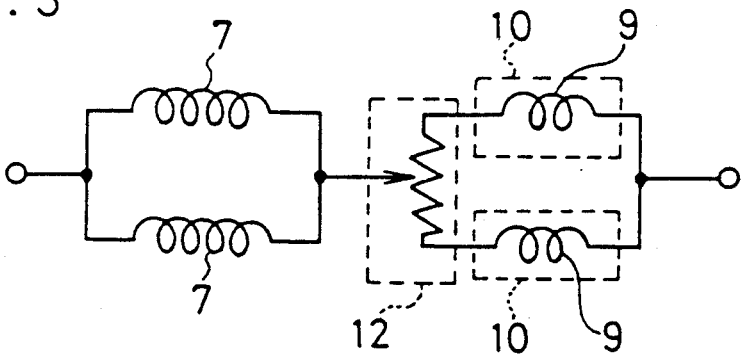
FIG. 3 is an electric circuit diagram showing an equivalent circuit of the deflection yoke assembly according to the present invention.

As shown in FIG. 3, the distortion correcting coils 9 on the respective magnetic core members 8 of the electromagnetic assemblies 10 are connected in series with the paired vertical deflection coils 7 through a differential resistor 12 so that the electromagnetic assemblies 10 can produce magnetic fluxes in a direction substantially perpendicular to the y-axis in synchronism with the cycle of vertical deflection.

The deflection yoke assembly 3 so constructed as hereinabove described in accordance with the first preferred embodiment of the present invention operates in the following manner.

Figure 4:
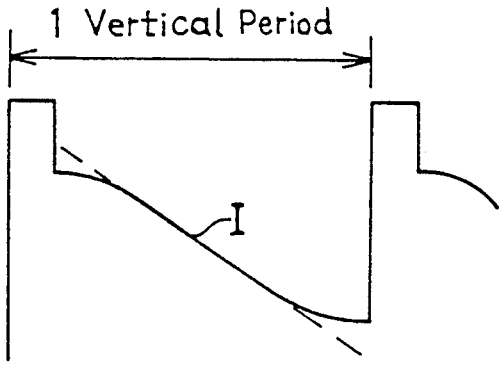
FIG. 4 is a diagram showing a characteristic of a vertical deflecting current.

As is well known to those skilled in the art, the vertical deflection current I is, as shown in FIG. 4, a current which does not linearly increase with deflection of the electron beams in the vertical direction from top to bottom of the phosphor deposited screen, that is, a current to which an S-shaped correction has been made. In other words, since the radius of curvature of the phosphor deposited screen is greater than the distance from the center of deflection of the electron beams to the center of the phosphor deposit screen in alignment with the longitudinal axis of the evacuated envelope and, for a given angle of deflection, a phenomenon tends to occur in which an image appearing at each side of the phosphor deposited screen is pulled wide in the vertical direction, the deflection current is corrected as the angle of deflection increases, thereby to improve the linearity, that is, to avoid the possibility of occurrence of the phenomenon referred to above.

With the deflection yoke assembly 3 of the above described construction according to the present invention, the electromagnetic assemblies 10, mounted on the radially outwardly extending front flange portion 3*a* of the coil separator 3A and spaced 180° circumferentially from each other about the longitudinal axis of the evacuated envelope, produce magnetic fluxes acting in a direction perpendicular to the vertical axis in synchronism with the cycle of vertical deflection, which magnetic fluxes exhibit a characteristic similar to the vertical deflection current with their intensities intensified at a portion of the phosphor deposited screen 1*b* intermediate of the Y-axis between the center and the top or the bottom of the screen 1*b* as compared with the magnets that are employed in the prior art deflection yoke assembly. Accordingly, the problem associated with the correction of the distortions which has arisen with the prior art deflection yoke assembly utilizing the permanent magnets can be substantially eliminated with the deflection yoke assembly according to the present invention.

Also, as is well known to those skilled in the art, the symmetrical relationship of the positions of the electron beams and that of the pattern of distribution of magnetic fields developed by the deflection yoke assembly, both in the currently mass-produced color cathode ray tubes, are not necessarily complete. Accordingly, as an adjusting mechanism operable to bring the electron beams and the axes of the deflection magnetic fields into exact alignment with each other, it is a general practice to swing a portion of the coil separator forming a part of the deflection yoke assembly which is adjacent the phosphor deposited screen about an opposite portion of the same coil separator adjacent the electron gum assembly to bring the axes into exact alignment with the electron beams. For example, if the position of the electron beams deviates from the center axis of the deflection magnetic fields in a direction upwardly of the phosphor deposited screen, the side electron beams 2B and 2R will be rotated counterclockwise and clockwise, respectively relative to the raster formed by the center electron beam 2B. However, by causing the portion of the deflection yoke assembly adjacent the phosphor deposited screen to swing upwards, the side electron beams 2B and 2R can be brought into alignment with the center electron beam 2G.

Figure 11:
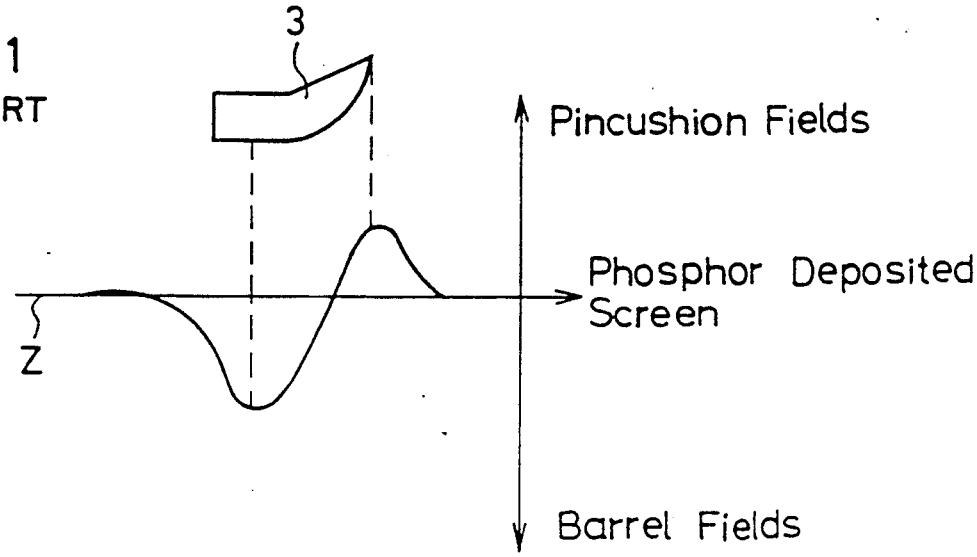
Fig. 11 PRIOR ART
Figure 12:
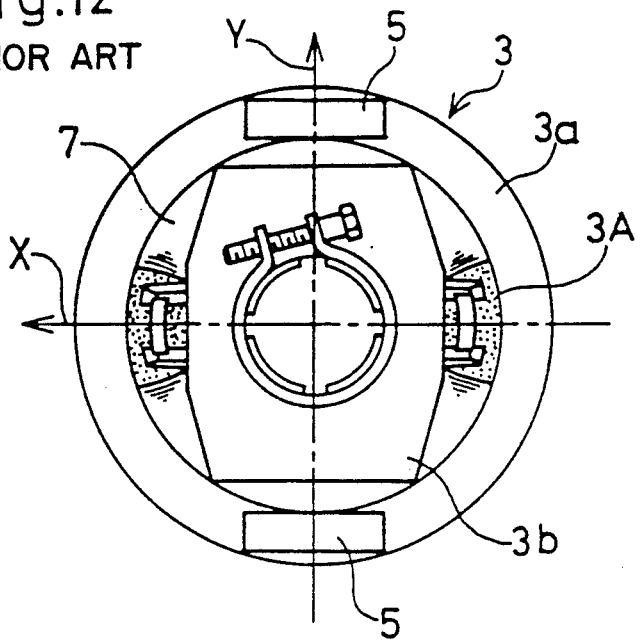
Fig.12 PRIOR ART
FIGS. 12 and 13 are schematic diagrams showing a rear end view of the conventional deflection yoke assembly designed to correct the raster distortions occurring in the conventional color cathode ray tube and a raster produced by such device, respectively.

However, since the pattern of distribution of the magnetic fields produced by the deflection yoke assembly is such that, as shown in FIG. 11, a very intensified barrel field is developed at a location adjacent that portion of the deflection yoke assembly adjacent the electron gun assembly about which it swings, a substantially increased amount of swing is necessitated. As a result thereof, the resultant raster distortion will exhibit a pincushion distortion at an upper portion of the phosphor deposited screen and a barrel distortion at a lower portion of the same phosphor deposited screen.

In view of the foregoing, and as shown in FIG. 3, by controlling the electric current, to be supplied across the first distortion correcting coils 9 positioned upwardly and downwardly with respect to the phosphor deposited screen and electrically connected with the vertical deflection coils 7 through the differential resistor 12, to increase or decrease, it is possible to intensify the pincushion fields at an upper region of the phosphor deposited screen and lessen the pincushion fields at a lower region of the phosphor deposited screen and, therefore, the occurrence of the raster distortions can be advantageously avoided even if the deflection yoke assembly is swung to bring the electron beams and the axes of the deflection magnetic fields into alignment with each other.

In the foregoing preferred embodiment of the present invention shown in and described with reference to FIGS. 1 to 3, the deflection yoke assembly 3 according to the present invention has been shown and described as comprised of the two electromagnetic assemblies 10 mounted on the radially outwardly extending front flange portion of the coil separator at respective locations spaced 180° circumferentially from each other about the longitudinal axis of the evacuated envelope while aligned along the Y-axis, that is, the vertical direction. However, in another preferred embodiment of the present invention which will now be described with reference to FIG. 5, the deflection yoke assembly 3 comprises, in addition to the two first electromagnetic assemblies 10, two second electromagnetic assemblies **10*a* for each first electromagnetic assembly 10**.

Figure 5:
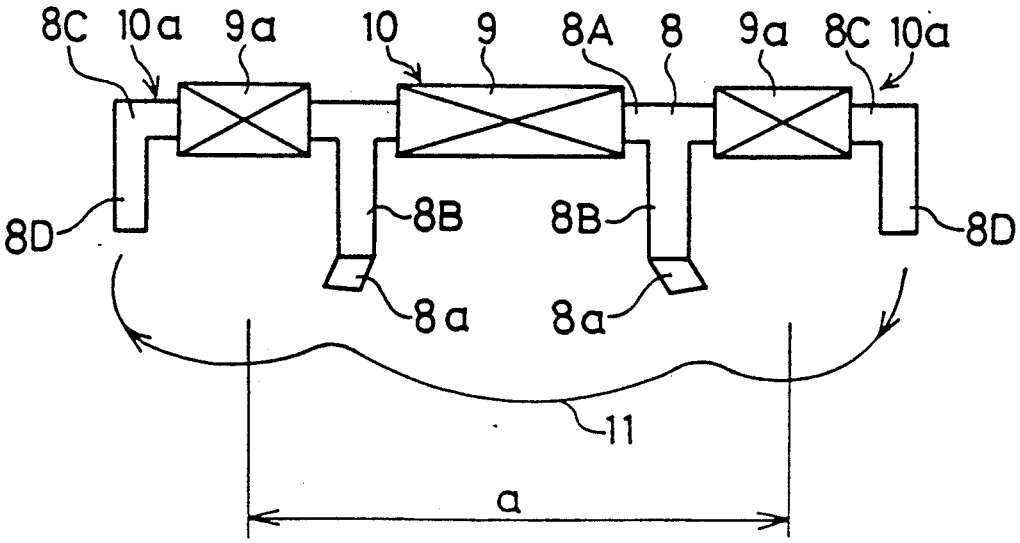
FIG. 5 is a schematic front elevational view showing an essential portion of the deflection yoke assembly according to another preferred embodiment of the present invention.
Figure 6:
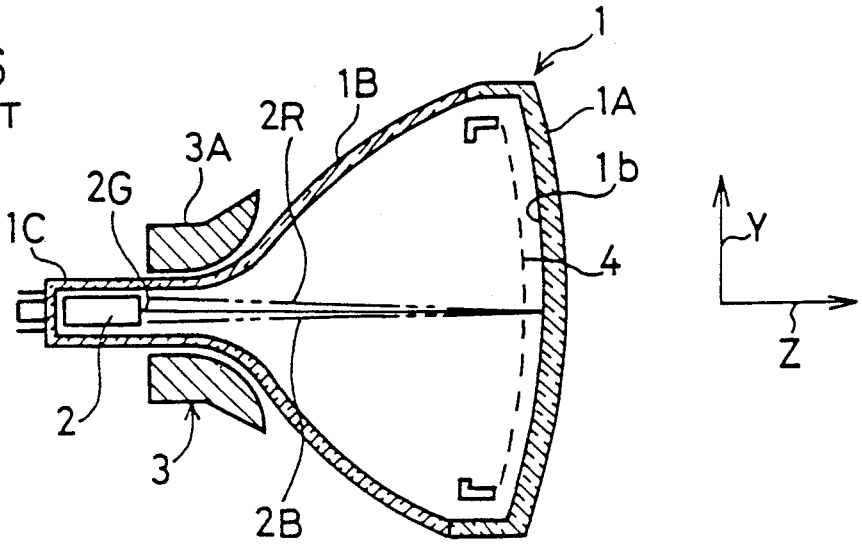
Fig. 6 PRIOR ART
FIG. 6 is a schematic longitudinal sectional view of the commercially available color cathode ray tube.
Figure 7:
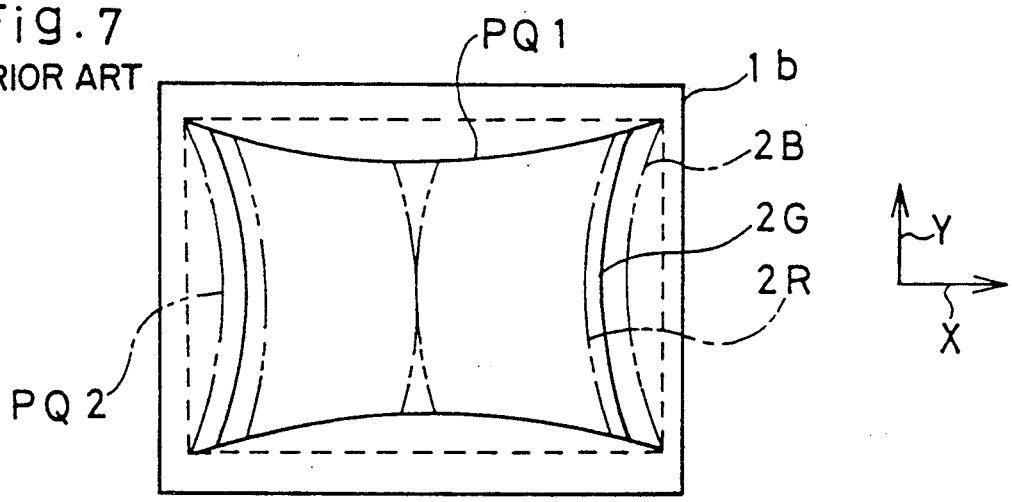
Fig. 7 PRIOR ART
FIGS. 7 to 11 are schematic diagrams used to explain the relationship between the deflection magnetic fields and the rasters in the conventional color cathode ray tube.
Figure 8:
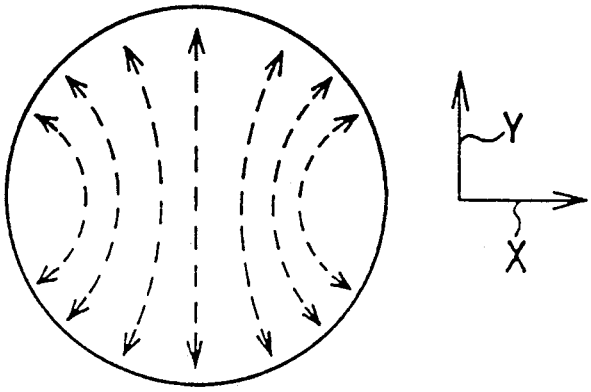
Fig. 8 PRIOR ART
Figure 9:
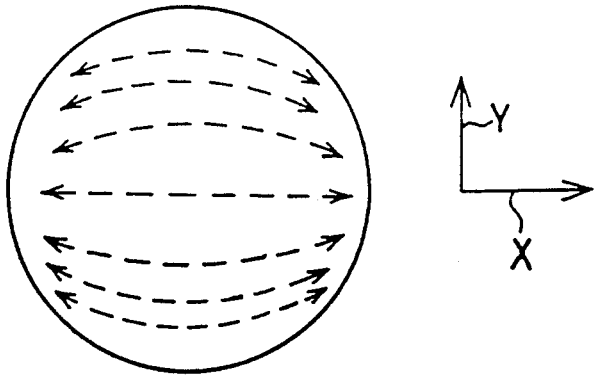
Fig. 9 PRIOR ART
Figure 10:
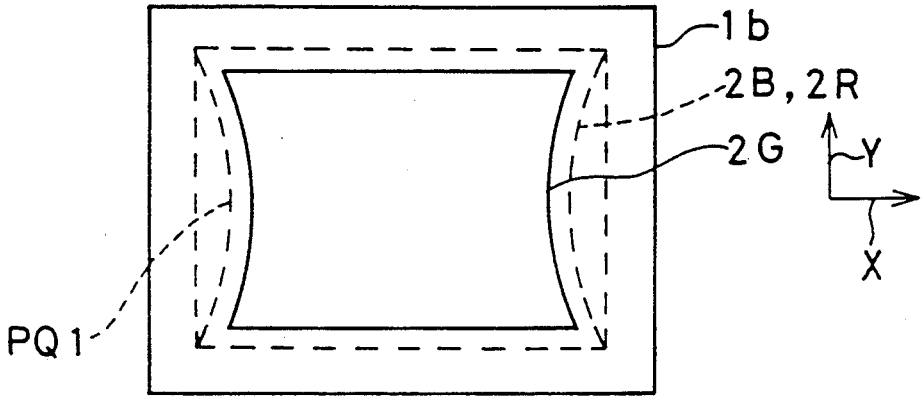
Fig. 10 PRIOR ART

More specifically, referring to FIG. 5, each of the two second electromagnetic assemblies **10*a* employed for each first electromagnetic assembly 10 comprises a generally L-shaped magnetic core member including a generally elongated core portion 8*c* integrated at one end to the joint between the arm 8B and the interconnecting core 8A of the associated U-shaped core member 8 so as to extend in line with the interconnecting core 8A, and an arm 8D perpendicular to the core portion 8*c* and extending from the opposite end of the core portion 8[c parallel to and in the same direction as any one of the arms 8B. Each second electromagnetic assembly 10*a* also comprises a second distortion coil 9*a* would and mounted on the elongated core portion 8*c* and electrically connected with the associated vertical deflection coils through a differential resistor in a manner similar to that shown in FIG. 3**.

The two second electromagnetic assemblies **10*a* positioned on the respective sides of the respective first electromagnetic assembly 10 are in symmetrical relationship with each other with respect to the first electromagnetic assembly 10**.

Figure 13:
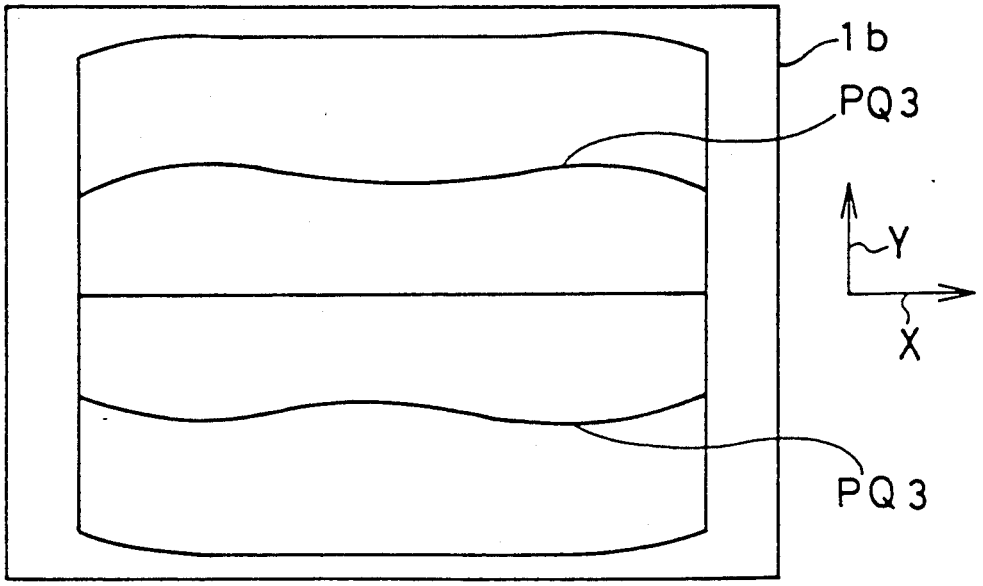

The deflection yoke assembly of the construction shown in and described with reference to FIG. 5, that is, of a type including the first electromagnetic assemblies 10 and the second electromagnetic assemblies **10*a* for each first electromagnetic assembly 10 operates in the following manner. Considering the electromagnetic device including each first electromagnetic assembly 10 and the associated second electromagnetic assemblies 10*a* therefor, and as clearly indicated in FIG. 5, magnetic fluxes developed by the electromagnetic device are distributed in a manner as indicated by 11, representing a pattern of three pincushion fields and, therefore, there magnetic fluxes can be rendered to represent a so-called gull shaped pattern of distribution of the magnetic fields within the range (as indicated by a) over which the magnetic fluxes so produced bring about influence on the electron beams being deflected so as to reach an area covering from the center area to each corner area of the phosphor deposited screen, whereby the raster distortions PQ3 of generally gull shape as shown in FIG. 13 can be advantageously eliminated. The required gull shaped pattern of distribution of the magnetic fluxes produced by the electromagnetic device can readily be attained if the number of turns of the first distortion correcting coil 9 is so selected as to be greater than the number of turns of any one of the second distortion correcting coils 9*a*, and/or if the span between the arm ends 8*a* and/or the span between one of the arm ends 8*a* and the adjacent arm 8D neighboring such one of the arm ends 8*a*** in the electromagnetic device are adequately selected.

As hereinbefore fully described, the present invention is such that the paired electromagnetic coil devices are mounted, on at least that radially outwardly extending front flange of the coil separator in alignment with the vertical axis perpendicular to the longitudinal axis of the evacuated envelope while spaced 180° circumferentially about the longitudinal axis of the envelope, for producing the magnetic fluxes in a direction substantially perpendicular to the vertical axis when these paired electromagnetic coil devices are energized in synchronism with the cycle of vertical deflection exercised by the vertical deflection coils. Accordingly, the occurrence of the raster distortions and mislanding can be substantially avoided.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

What is claimed is:

1. A deflection yoke assembly for use on a cathode ray tube comprising an evacuated envelope having a funnel section, a faceplate at one end of the funnel section and a neck section at the opposite end of the funnel section, a coil separator mounted exteriorly on the evacuated envelope at a location corresponding to the boundary between the funnel section and the neck section and having a generally conical portion of a shape following an outer contour of the evacuated envelope, a radially outwardly flanged front end portion at one end of the conical portion and a radially outwardly flanged rear end portion at the opposite end of the conical portion, a pair of horizontal deflection coils and a pair of vertical deflection coils both wound on the coil separator, said deflection yoke assembly comprising:

vertical deflection distortion correcting means including two electromagnetic devices mounted on said radially outwardly flanged front end portion of the coil separator in alignment with a vertical axis perpendicular to the longitudinal axis of the evacuated envelope while spaced 180° circumferentially about the longitudinal axis of the evacuated envelope, said electromagnetic devices generating magnetic fluxes in a direction substantially perpendicular to the vertical axis when electrically energized in synchronism with the cycle of vertical deflection exercised by the vertical deflection coils.

2. The deflection yoke assembly as claimed in claim 1, wherein each of said electromagnetic devices, comprises a generally U-shaped magnetic core member having spaced apart arms and an interconnecting core portion connecting said arms together, and an electromagnetic coil mounted on said interconnecting core portion.

3. The deflection yoke assembly as claimed in claim 2, wherein said arms have respective free ends, said free ends protruding so as to terminate in the vicinity of an outer surface of the evacuated envelope.

4. The deflection yoke assembly as claimed in claim 1, wherein each of the electromagnetic devices is electrically connected with the vertical deflection coils through a differential resistor.

5. The deflection yoke assembly as claimed in claim 1, wherein each of said electromagnetic devices comprises a first electromagnetic assembly and a pair of second electromagnetic assemblies positioned on respective sides of said first electromagnetic assembly, said first and second electromagnetic assemblies being capable of generating the magnetic fluxes in a direction substantially perpendicular to the vertical axis in synchronism with the cycle of vertical deflection exercised by the vertical deflection coils.

6. The deflection yoke assembly as claimed in claim 5, wherein said first electromagnetic assembly includes a first electromagnetic oil and said second electromagnetic assemblies include respective second electromagnetic coils, said first and second electromagnetic coils being wound on a common magnetic core member, said, magnetic core member having an interconnecting portion and a pair of fist arms at respective opposite ends of said interconnecting portion and extending perpendicular to said interconnecting portion, core extensions extending axially from the opposite ends of said interconnecting portion in respective directions opposite to each other and second arms extending from respective free ends of said core extensions in a direction perpendicular thereto and in the same direction as the direction in which each of said first arms extends, said first electromagnetic oil being mounted on said interconnecting portion while said second electromagnetic coils are mounted on the respective core extensions.

7. The deflection yoke assembly as claimed in claim 6, wherein said first and second electromagnetic assemblies are electrically connected with the vertical deflection coils through a differential resistor.

8. A deflection yoke assembly for use on a cathode ray tube comprising an evacuated envelope having a funnel section, a faceplate mounted at one end of the funnel section and a neck section, having two opposing ends, mounted at the opposite end of the funnel section, a coil separator mounted exteriorly on the evacuated envelope at a location corresponding to the boundary between the funnel section and the neck section and having a generally conical portion of a shape following an outer contour of the evacuated envelope, a radially outwardly flanged front end portion at one end of the conical portion and a radially outwardly flanged rear end portion at the opposite end of the conical portion, a pair of horizontal deflection coils, a pair of vertical deflection coils both wound on the coil separator, and an in-line electron gun assembly mounted within the neck section at one end of said opposing ends away from the funnel section for emitting three electron beams, said deflection yoke assembly comprising:

vertical deflection distortion correcting means including two electromagnetic devices mounted on said radially outwardly flanged front end portion of the coil separator in alignment with a vertical axis perpendicular to the longitudinal axis of the evacuated envelope while spaced 180° circumferentially about the longitudinal axis of the evacuated envelope, said electromagnetic devices generating magnetic fluxes in a direction substantially perpendicular to the vertical axis when electrically energized in synchronism with the cycle of vertical deflection exercised by the vertical deflection coils to deviate the three electron beams in a same direction along the vertical axis.

9. The deflection yoke assembly as claimed in claim 8, wherein each of said electromagnetic devices comprises a generally U-shaped magnetic core member having spaced apart arms and an interconnecting core portion connecting said arms together, and an electromagnetic coil mounted on said interconnecting core portion.

10. The deflection yoke assembly as claimed in claim 9, wherein said arms have respective free ends, said free ends protruding so as to terminate in the vicinity of an outer surface of the evacuated envelope.

11. The deflection yoke assembly as claimed in claim 8, wherein each of the electromagnetic devices is electrically connected with the vertical deflection coils through a differential resistor.

12. The deflection yoke assembly as claimed in claim 8, wherein each of said electromagnetic devices comprises a first electromagnetic assembly and a pair of second electromagnetic assemblies positioned on respective sides of said first electromagnetic assembly, said first and second electromagnetic assemblies being capable of generating the magnetic fluxes in a direction substantially perpendicular to the vertical axis in synchronism with the cycle of vertical deflection exercised by the vertical deflection coils.

13. The deflection yoke assembly as claimed in claim 12, wherein said first electromagnetic assembly includes a first electromagnetic coil and said second electromagnetic assemblies include respective second electromagnetic coils, said first and second electromagnetic coils being wound on a common magnetic core member, said common magnetic core member having an interconnecting portion and a pair of first arms at respective opposite ends of said interconnecting portion and extending perpendicular to said interconnecting portion, core extensions extending axially from the opposite ends of said interconnecting portion in respective directions opposite to each other and second arms extending from respective free ends of said core extensions in a direction perpendicular thereto and in the same direction as the direction in which each of said first arms extends, said first electromagnetic coil being mounted on said interconnecting portion while said second electromagnetic coils are mounted on the respective core extensions.

14. The deflection yoke assembly as claimed in claim 13, wherein said first and second electromagnetic assemblies are electrically connected with the vertical deflection coils through a differential resistor.

15. The deflection yoke assembly for use on a cathode ray tube comprising an evacuated envelope having a funnel section, a faceplate mounted at one end of the funnel section and a neck section mounted at the opposite end of the funnel section, a coil separator mounted exteriorly on the evacuated envelope at a location corresponding to the boundary between the funnel section and the neck section and having a generally conical portion of a shape following an outer contour of the evacuated envelope, a radially outwardly flanged front end portion at one end of the conical portion and a radially outwardly flanged rear end portion at the opposite end of the conical portion, a pair of horizontal deflection coils and a pair of vertical deflection coils both wound on the coil separator, said deflection yoke assembly comprising:

vertical deflection distortion correcting means including two electromagnetic devices mounted on said radially outwardly flanged front end portion of the coil separator in alignment with a vertical axis perpendicular to the longitudinal axis of the evacuated envelope while spaced 180° circumferentially about the longitudinal axis of the evacuated envelope, said electromagnetic devices generating magnetic fluxes in a direction substantially perpendicular to the vertical axis when electrically energized in synchronism with the cycle of vertical deflection exercised by the vertical deflection coils to eliminate a raster distortion appearing at an intermediate portion of a screen at a location between a horizontal axis and a top or bottom portion of said screen.

16. The deflection yoke assembly as claimed in claim 15, wherein each of said electromagnetic devices comprises a generally U-shaped magnetic core member having spaced apart arms and an interconnecting core portion connecting said arms together, and an electromagnetic coil mounted on said interconnecting core portion.

17. The deflection yoke assembly as claimed in claim 16, wherein said arms have respective free ends, said free ends protruding so as to terminate in the vicinity of an outer surface of the evacuated envelope.

18. The deflection yoke assembly as claimed in claim 15, wherein each of the electromagnetic devices is electrically connected with the vertical deflection coils through a differential resistor.

19. The deflection yoke assembly as claimed in claim 15, wherein each of said electromagnetic devices comprises a first electromagnetic assembly and a pair of second electromagnetic assemblies positioned on respective sides of said first electromagnetic assembly, said first and second electromagnetic assemblies being capable of generating the magnetic fluxes in a direction substantially perpendicular to the vertical axis in synchronism with the cycle of vertical deflection exercised by the vertical deflection coils.

20. The deflection yoke assembly as claimed in claim 19, wherein said first electromagnetic assembly includes a first electromagnetic coil and said second electromagnetic assemblies include respective second electromagnetic coils, said first and second electromagnetic coils being wound on a common magnetic core member, said common magnetic core member having an interconnecting portion and a pair of first arms at respective opposite ends of said interconnecting portion and extending perpendicular to said interconnecting portion, core extensions extending axially from the opposite ends of said interconnecting portion in respective directions opposite to each other and second arms extending from respective free ends of said core extensions in a direction perpendicular thereto and in the same direction as the directions in which each of said first arms extends, said first electromagnetic coil being mounted on said interconnecting portion while said second electromagnetic coils are mounted on the respective core extensions.

21. The deflection yoke assembly as claimed in claim 20, wherein said first and second electromagnetic assemblies are electrically connected with the vertical deflection coils through a differential resistor.

22. A color cathode ray tube comprising:

evacuated envelope means having a funnel section of first and second ends with a neck section mounted to said first end and a faceplate mounted to said second end;

coil separator means mounted exteriorly on said evacuated envelope at the boundary between said funnel section and said neck section; and vertical deflection distortion correcting means including two electromagnetic devices, mounted on a radially outwardly flanged front portion of said coil separator means in alignment with a vertical axis perpendicular to a longitudinal axis of said evacuated envelope means and spaced 180° circumferentially about the longitudinal axis of said evacuated envelope means, for generating magnetic fluxes in a direction substantially perpendicular to said vertical axis to eliminate a raster distortion appearing at an intermediate portion of a screen at a location between a horizontal axis and a top or bottom portion of said screen.

23. The color cathode ray tube of claim 11 further comprising a pair of horizontal deflection coils and a pair of vertical deflection coils both wound on said coil separator.

24. The color cathode ray tube of claim 23, wherein each of said electromagnetic devices comprises a generally U-shaped magnetic core member having spaced apart arms and an interconnecting core portion connecting said arms together, and an electromagnetic coil mounted on said interconnecting core portion.

25. The color cathode ray tube of claim 24, wherein said arms have respective free ends, said free ends protruding so as to terminate in the vicinity of an outer surface of said evacuated envelope means.

26. The color cathode ray tube of claim 25, wherein each of said electromagnetic devices is electrically connected with said vertical deflection coils through a differential resistor.

27. The color cathode ray tube of claim 26, wherein each of said electromagnetic devices comprises a first electromagnetic assembly and a pair of second electromagnetic assemblies positioned on respective sides of said first electromagnetic assembly, said first and second electromagnetic assemblies being capable of generating the magnetic fluxes in a direction substantially perpendicular to a vertical fluxes in a direction substantially perpendicular to a vertical axis in synchronism with the cycle of vertical deflection exercised by said vertical deflection coils.

28. The color cathode ray tube of claim 27, wherein said first electromagnetic assembly includes a first electromagnetic coil and said second electromagnetic assemblies include respective second electromagnetic coils, said first and second electromagnetic coils being wound on a common magnetic core member, said common magnetic core member having an interconnecting portion and a pair of first arms at respective opposite ends of said interconnecting portion and extending perpendicular to said interconnecting portion, core extensions extending axially from the opposite ends of said interconnecting portion in respective directions opposite to each other and second arms extending from respective free ends of said core extensions in a direction perpendicular thereto and in the same direction as the direction in which each of said first arms extends, said first electromagnetic coil being mounted on said interconnecting portion while said second electromagnetic coils are mounted on the respective core extensions.

29. A deflection yoke assembly, for use with a color cathode ray tube, including two electromagnetic devices mounted on a radially outwardly extending flanged front portion of a coil separator, and spaced 180° circumferentially about the coil separator, for eliminating raster distortion, each of the electromagnetic devices comprising:

magnetic core mean shaving opposite first and second ends with a first electromagnetic coil means mounted thereon;

first and second arms extending from said first and second ends, respectively, parallel to each other and perpendicular to said magnetic core means;

first and second core extensions, with first and second opposing ends, extending axially outward from said respective first and second ends of said magnetic core means with second and third electromagnetic coil and means mounted respectively on said first and second core extensions; and third and fourth arm respectively extending from said first and second core extensions from said respective ends opposing said magnetic core means, said third and fourth arms extending parallel to said first and second arms.

* * * * *